US008367953B2

(12) United States Patent
Beaulieu

(10) Patent No.: US 8,367,953 B2
(45) Date of Patent: Feb. 5, 2013

(54) PNEUMATIC SYSTEM ELECTRICAL CONTACT DEVICE

(75) Inventor: Gilles Beaulieu, Trois-Rivieres (CA)

(73) Assignee: MAC Valves, Inc., Wixom, MI (US)

( * ) Notice: Subject to any disclaimer, the term of this patent is extended or adjusted under 35 U.S.C. 154(b) by 355 days.

(21) Appl. No.: 12/886,222

(22) Filed: Sep. 20, 2010

(65) Prior Publication Data

US 2011/0008995 A1 Jan. 13, 2011

Related U.S. Application Data

(63) Continuation-in-part of application No. 12/140,554, filed on Jun. 17, 2008, now Pat. No. 7,915,550.

(51) Int. Cl.
*H01H 1/06* (2006.01)
*H01H 35/38* (2006.01)

(52) U.S. Cl. ..... 200/275; 200/82 R; 200/276

(58) Field of Classification Search ..... 200/16 R–16 D, 200/51 R, 51.09, 51.12, 61.22, 61.25, 81 R, 200/82 R–82 A, 239, 243, 250, 251, 275, 200/276, 61.2, 84 R–84 C
See application file for complete search history.

(56) References Cited

U.S. PATENT DOCUMENTS

| | | | | |
|---|---|---|---|---|
| 3,006,825 | A | | 10/1961 | Ovrom Sem |
| 3,371,026 | A | | 2/1968 | Kiley et al. |
| 3,406,800 | A | * | 10/1968 | Buchanan et al. ..... 192/85.57 |
| 3,663,411 | A | | 5/1972 | Springer |
| 3,679,555 | A | | 7/1972 | Duclaux et al. |
| 3,681,229 | A | | 8/1972 | Lowe |
| 3,942,366 | A | | 3/1976 | Hofmann |
| 4,016,053 | A | | 4/1977 | Stankovich et al. |
| 4,019,561 | A | | 4/1977 | Aoki |
| 4,028,511 | A | | 6/1977 | Wack et al. |
| 4,035,251 | A | | 7/1977 | Shiver et al. |
| 4,049,529 | A | | 9/1977 | Golla |
| 4,053,384 | A | | 10/1977 | Siegmund |
| 4,070,008 | A | | 1/1978 | Schlieckmann |
| 4,085,305 | A | | 4/1978 | Dietz |
| 4,092,118 | A | | 5/1978 | Muhle |
| 4,228,924 | A | | 10/1980 | Gilbert |
| 4,321,115 | A | | 3/1982 | Rebmann et al. |
| 4,328,085 | A | | 5/1982 | Friedli et al. |
| 4,332,660 | A | | 6/1982 | Friedli et al. |

(Continued)

FOREIGN PATENT DOCUMENTS

| | | |
|---|---|---|
| CA | 800598 | 12/1968 |
| CA | 1022497 | 12/1977 |

(Continued)

*Primary Examiner* — Michael Friedhofer
(74) *Attorney, Agent, or Firm* — Harness, Dickey & Pierce, P.L.C.

(57) ABSTRACT

An electrical contact device for controlling operation of an aluminum processing bath includes an electrically insulating body and a first bore having a first diameter. The first bore opens into a through second bore having a second diameter smaller than the first diameter. The second bore opens into a third bore having a third diameter greater than the first and second diameters. A fastener received in the body includes a shank having a male threaded portion and a male threaded head. A conductive biasing element has a connecting end engaged with the male threaded head. The connecting end and the male threaded head are slidably received in the first bore, and the shank is slidably received in the second bore. The male threaded portion extends into the third bore. A nut positioned in the third bore engages the male threaded portion coupling the fastener and tubular body.

37 Claims, 17 Drawing Sheets

U.S. PATENT DOCUMENTS

| | | | | |
|---|---|---|---|---|
| 4,349,231 | A | 9/1982 | Gut et al. | |
| 4,377,452 | A | 3/1983 | Casdas | |
| 4,431,491 | A | 2/1984 | Bonny et al. | |
| 4,437,964 | A | 3/1984 | Gerphagnon et al. | |
| 4,469,281 | A | 9/1984 | Røed | |
| 4,480,160 | A | 10/1984 | Stifelman | |
| 4,510,033 | A | 4/1985 | Martin et al. | |
| 4,534,401 | A | 8/1985 | Schaumburg et al. | |
| 4,563,255 | A | 1/1986 | Heinzmann et al. | |
| 4,617,100 | A | 10/1986 | Boughton | |
| 4,755,637 | A | 7/1988 | Turck | |
| 5,011,399 | A | 4/1991 | Farrell | |
| 5,045,168 | A | 9/1991 | Dalen et al. | |
| 5,078,849 | A | 1/1992 | Sagbraten | |
| 5,225,641 | A | 7/1993 | Weld et al. | |
| 5,294,318 | A | 3/1994 | Grant, Jr. et al. | |
| 5,477,675 | A | 12/1995 | Ingraham et al. | |
| 5,491,465 | A * | 2/1996 | Adams | 340/442 |
| 5,540,556 | A | 7/1996 | Du | |
| 5,613,834 | A | 3/1997 | Du | |
| 5,749,709 | A | 5/1998 | Du | |
| 5,779,875 | A | 7/1998 | Budaev et al. | |
| 6,239,393 | B1 * | 5/2001 | Hansen | 200/276 |
| 6,436,270 | B1 | 8/2002 | Sander | |
| 6,440,294 | B1 | 8/2002 | Cotten | |
| 6,479,773 | B2 * | 11/2002 | Bienvenu | 200/275 |
| 6,555,050 | B1 | 4/2003 | Groteke et al. | |
| 6,649,035 | B2 | 11/2003 | Horstmann et al. | |
| 6,720,511 | B2 * | 4/2004 | Windebank | 200/275 |
| 6,755,112 | B2 | 6/2004 | Burgdorf et al. | |
| 7,075,023 | B2 * | 7/2006 | Kent et al. | 200/276 |
| 7,114,597 | B2 | 10/2006 | Siebke | |
| 7,915,550 | B2 * | 3/2011 | Beaulieu | 200/275 |
| 2002/0020615 | A1 * | 2/2002 | Bienvenu | 200/275 |
| 2004/0045799 | A1 * | 3/2004 | Windebank | 200/275 |
| 2006/0219540 | A1 * | 10/2006 | Kent et al. | 200/276 |
| 2007/0095134 | A1 * | 5/2007 | Lehtonen | 73/146.5 |
| 2008/0066834 | A1 | 3/2008 | Jepson | |

FOREIGN PATENT DOCUMENTS

| | | |
|---|---|---|
| GB | 1 262 069 | 2/1972 |

* cited by examiner

PNEUMATIC SYSTEM ELECTRICAL CONTACT DEVICE

CROSS-REFERENCE TO RELATED APPLICATIONS

This application is a continuation-in-part of U.S. patent application Ser. No. 12/140,554 filed on Jun. 17, 2008. The entire disclosure of the above application is incorporated herein by reference.

FIELD

The present disclosure relates to contact devices used to close electrical circuits.

BACKGROUND

The statements in this section merely provide background information related to the present disclosure and may not constitute prior art.

Known systems used to control operations of aluminum processing baths can include electrical circuits closed when a crust breaking tool breaks an aperture through the hardened upper crust formed on the bath and either encounters a layer of alumina, or the molten layer of aluminum below the layer of alumina. The aperture formed through the crust is necessary to permit feeding new alumina material into the bath. When the electrical circuit closes, a signal is created which directs the crust breaking tool to retract from the crust layer. An example of such a system is disclosed in U.S. Pat. No. 6,649,035 to Horstmann et al. A drawback of such systems occurs when crust material forms on the crust breaking tool or corrosive effects of the bath prevent completion of the electrical circuit.

In this situation, the crust breaking tool can remain in the bath for an undesirable length of time which can further damage the crust breaking tool, or render the detection system inoperative, which prevents feeding of the alumina material, or identification of how many feed events have occurred. A further drawback is the crust breaking tool is generally driven by a system using high pressure air. The longer the crust breaking tool is suspended, the greater volume of high pressure air is required, which increases operating costs of the system and may increase the number of air compressors and air dryers required for operation.

SUMMARY

According to several embodiments of the present disclosure, an electrical contact device operable to complete an electrical circuit includes a tubular body of an electrically insulating material. The body includes a seal member to permit the tubular body to be sealingly disposed within a cylinder. A fastener is received in the tubular body. The fastener includes a shank and a plurality of threads. A conductive biasing element has a compressed connecting end engaged with the plurality of threads, and an extending portion extending from the compressed connecting end.

According to other embodiments, an electrical contact device operable to complete an electrical circuit includes a tubular body of an electrically insulating material. The tubular body includes an open receiving end having a fastener clearance bore, an internally threaded bore, and a biasing element clearance bore. A fastener made of an electrically conductive material includes a shank having a plurality of external shank threads adapted to be threadably engaged with the internally threaded bore, and a shank extension extending axially from the shank. A conductive biasing element includes a compressed connecting end mechanically and conductively engaged with the shank extension, and a extending portionextending from the compressed connecting end.

According to other embodiments, an electrical circuit operating system includes an electrical contact device having a tubular body of an electrically insulating material. The body includes a seal member. A fastener is disposed in the tubular body. A conductive biasing element has a compressed connecting end engaged with the fastener, and an extending portion axially protracting from the compressed connecting end. A displaceable member forms a portion of an electrical circuit, the electrical circuit closed when the conductive biasing element is contacted by the displaceable member.

According to still other embodiments, an operating system is operable to direct a pressurized fluid to displace the displaceable member.

According to still other embodiments, an electrical circuit operating system for controlling operating of an aluminum processing bath includes an electrical contact device. The electrical contact device includes a tubular body of an electrically insulating material, the body including a seal member. A fastener is disposed in the tubular body. A conductive biasing element has a compressed connecting end engaged with the fastener, and an extending portion axially protracting from the compressed connecting end. A piston forms a portion of an electrical circuit. The electrical circuit is closed when the conductive biasing element is contacted by the piston. A piston rod is connected to the piston and is displaceable with the piston, the piston rod operable to break a crust of the aluminum processing bath.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
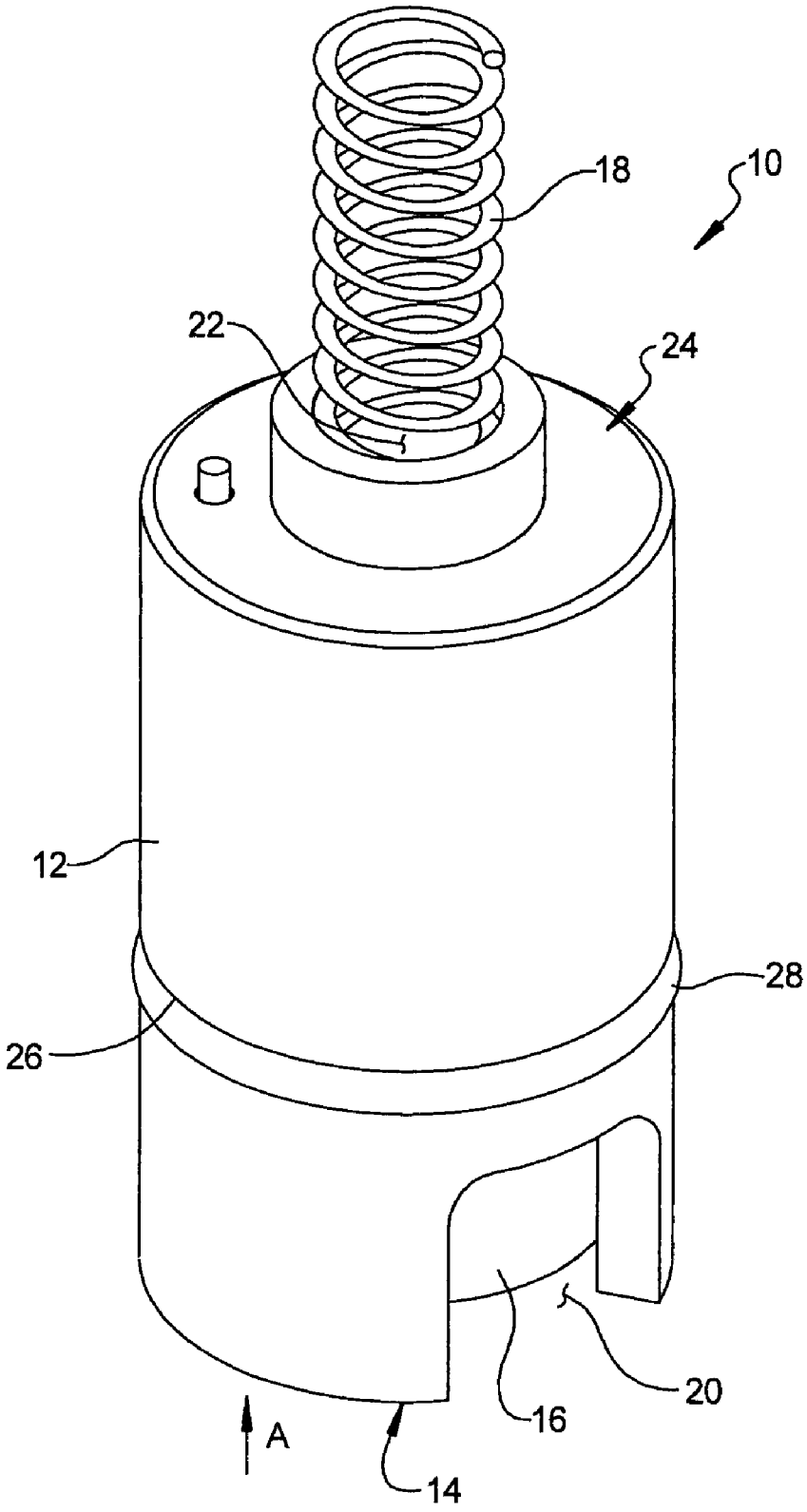
FIG. 1 is a front perspective view of a pneumatic system electrical contact device of the present disclosure.

The following description is merely exemplary in nature and is not intended to limit the present disclosure, application, or uses. It should be understood that throughout the drawings, corresponding reference numerals indicate like or corresponding parts and features.

Referring to FIG. 1, an electrical connector assembly 10 includes an electrically insulating tubular body 12 having an open receiving end 14 through which is received a fastener 16. A biasing element 18 such as a coiled compression spring is electrically and mechanically connected to the fastener 16 and extends outwardly of tubular body 12. An access cavity 20 is provided in a wall of tubular body 12 to provide access to fastener 16 to extend an electrical connection with fastener 16. The biasing element 18 extends partially through and outwardly from a biasing element bore 22 which is created through an end face 24 of tubular body 12. End face 24 is oppositely positioned from the open receiving end 14.

According to several embodiments, a seal is provided with tubular body 12 so tubular body 12 can form a portion of a pressure boundary. The seal can be formed as a flange extending from the tubular body, an O-ring seated about the tubular body 12, a raised surface of the tubular body 12, and the like. According to several embodiments and as shown in FIG. 1, at least one perimeter or circumferential slot 26 is provided in tubular body 12 which is adapted to receive a seal member 28 such as an elastomeric O-ring. As noted above, circumferential slot 26 can be eliminated and seal member 28 can be formed as a protuberance, flange, or extension of tubular body 12.

Fastener 16 is assembled into tubular body 12 in an insertion direction "A" through open receiving end 14. According to several embodiments, fastener 16 is pre-connected to biasing element 18 such that both fastener 16 and biasing element 18 can be together loaded into tubular body 12 at the same time in the insertion direction "A". Fastener 16 is adapted to be threadably received within tubular body 12. A material of tubular body 12 is selected from an electrically non-conductive material, which according to several embodiments can be a polymeric material such as a polytetrafluoroethylene, a perfluoroalkoxy material, or a fluorinated ethyleneproplylene material. The material for tubular body 12 is selected both for its temperature resistance and for its ability to provide electrical insulation properties and is not limited to the materials listed above. According to several embodiments, fastener 16 is made from an electrically conductive material including a metal such as steel. Material for the biasing element 18 is also an electrically conductive material which can include a metal such as stainless steel including 1700 stainless steel. According to several embodiments, biasing element 18 is in the form of a coiled compression spring, however biasing element 18 can be provided in other forms that allow for axial or longitudinal deflection.

Figure 2:
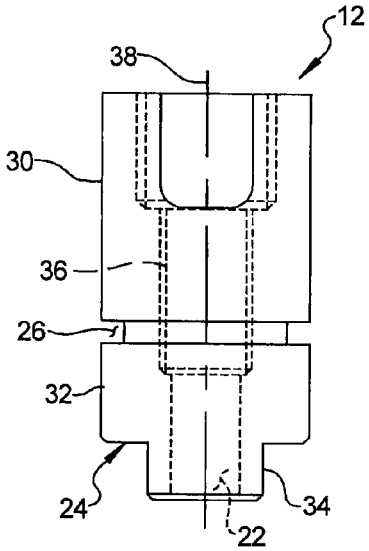
FIG. 2 is a front elevational view of a tubular body for the electrical contact device of FIG. 1.

Referring to FIG. 2, according to embodiments that provide for seal member 28 as an elastomeric O-ring, tubular body 12 includes a first body portion 30 and a second body portion 32 separated from first body portion 30 by perimeter slot 26. A raised boss 34 extends longitudinally from and is homogenously joined to second body portion 32. Boss 34 has a diameter smaller than a diameter of either first or second body portions 30, 32. Boss 34 is provided to extend an axial length of biasing element bore 22 to assist with maintaining an axial alignment of biasing element 18 as biasing element 18 extends freely away from tubular body 12. An internal threaded bore 36 is also provided in tubular boy 12 which is coaxially aligned together with biasing element bore 22 on a bore longitudinal axis 38 of tubular body 12. Boss 34 extends axially away from end face 24 and can be coaxially aligned with bore longitudinal axis 38.

Figure 3:
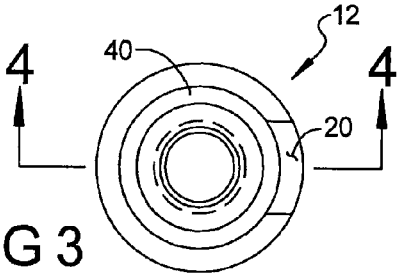
FIG. 3 is a top plan view of the electrical contact device of FIG. 1.

Referring to FIG. 3, a fastener clearance bore 40 can be created in tubular body 12. Fastener clearance bore 40 is sized to slidably receive fastener 16. Access cavity 20 extends transversely with respect to fastener clearance bore 40.

Figure 4:
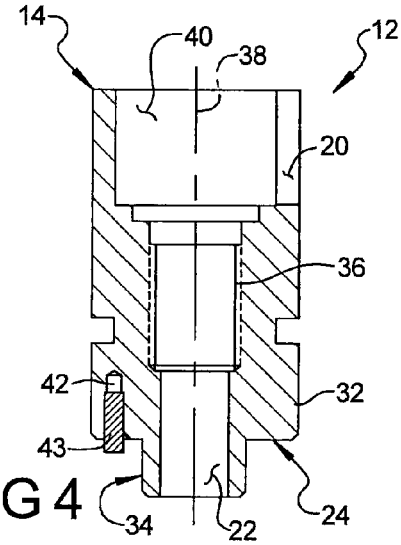
FIG. 4 is a cross sectional front elevational view taken at section 4 of FIG. 3.
Figure 5:
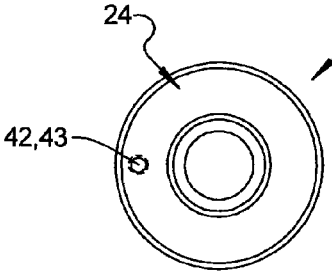
FIG. 5 is a bottom plan view of the electrical contact device of FIG. 1.

Referring to FIGS. 4 and 5, a perimeter aperture 42 is created in end face 24 and extends substantially parallel to bore longitudinal axis 38. According to several embodiments, perimeter aperture 42 is a blind aperture opening only from end face 24 and extending partially through second body portion 32. Perimeter aperture 42 is adapted to engagingly receive an anti-rotation pin 43 whose function will be described in reference to FIG. 12. According to several embodiments, fastener clearance bore 40 has a larger diameter than a diameter of internal threaded bore 36, which in turn has a larger diameter than a diameter of biasing element bore 22.

Figure 6:
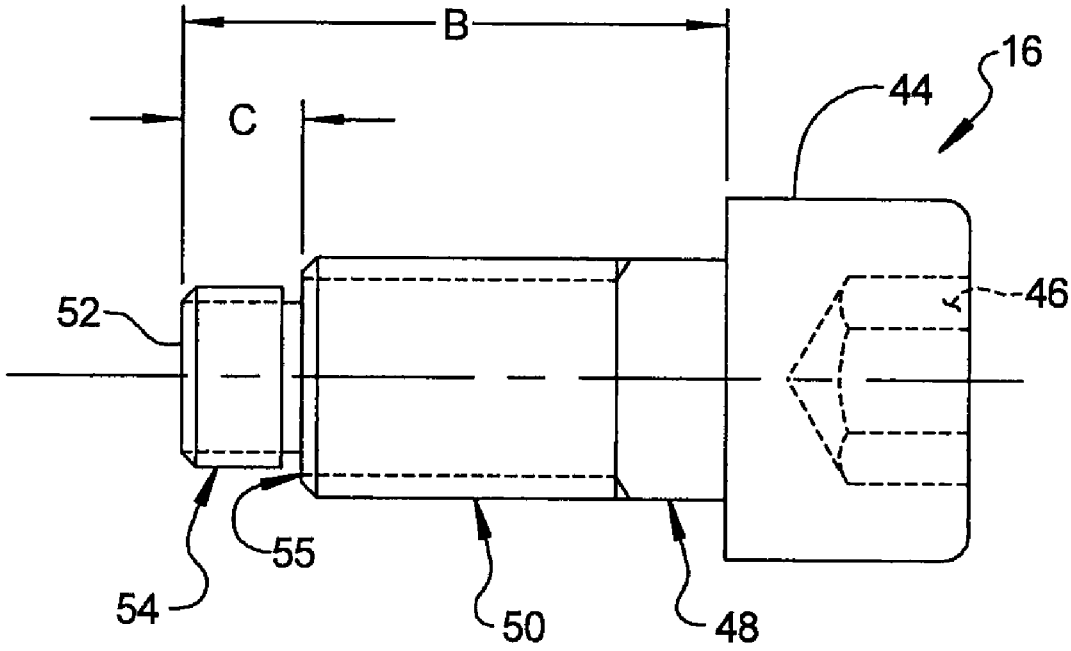
FIG. 6 is a side elevational view of a fastener for the electrical contact device of FIG. 1.

Referring to FIG. 6, fastener 16 includes a fastener head 44 which has a recessed drive slot 46. The geometry of recessed drive slot 46 can be selected to receive one of a plurality of different installation tools for installation of fastener 16. According to several embodiments, recessed drive slot 46 defines a hexagonal slot adapted to receive an Allen wrench. A shank 48 extends axially from fastener head 44. A plurality of male shank threads 50 are created on shank 48. A reduced diameter shank extension 52 having a diameter smaller than a diameter of shank 48 extends axially away from shank 48 and is positioned opposite to fastener head 44. A plurality of male extension threads 54 are created on reduced diameter shank extension 52. According to several embodiments, male extension threads 54 are a 40 UNF left hand thread and male shank threads 50 are a 13 UNC right hand thread. The use of left hand or right hand threads as noted can also be modified within the scope of the present disclosure. An end face 55 is created at a junction between shank 48 and reduced diameter shank extension 52. Fastener 16 can have a total shank length "B" which in several embodiments is 1.125 in (2.86 cm), and reduced diameter shank extension 52 can have an extension length "C" which can be 0.25 in (0.63 cm).

Figure 7:
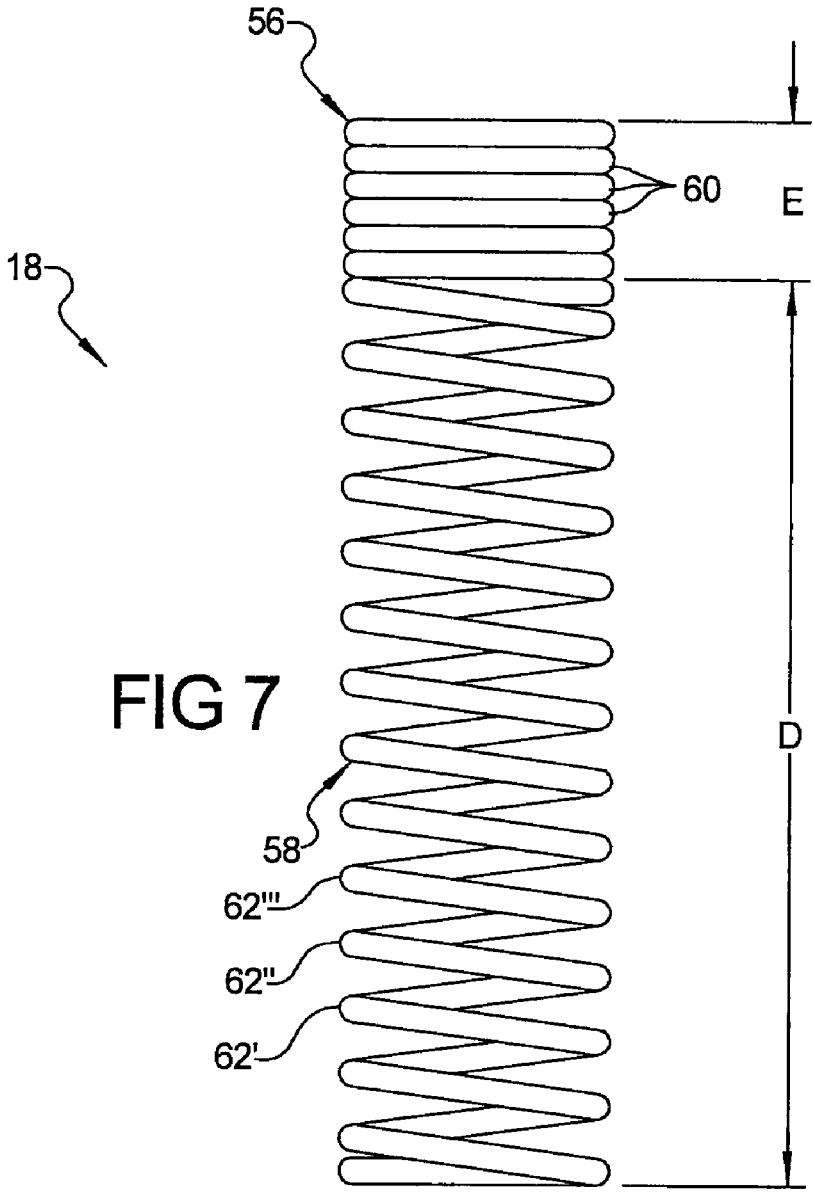
FIG. 7 is a side elevational view of a biasing element for the electrical contact device of FIG. 1.
Figure 8:
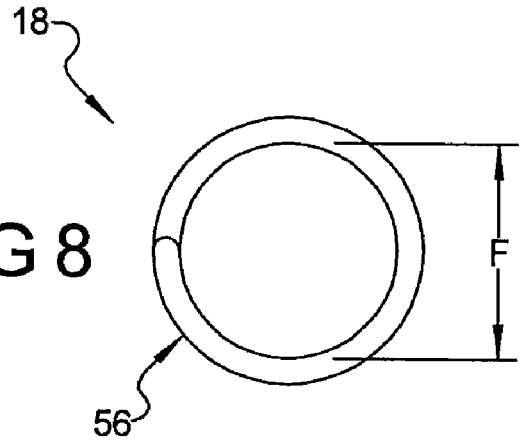
FIG. 8 is a front elevational view of the biasing element of FIG. 7.

Referring to both FIGS. 7 and 8 and again to FIG. 6, biasing element 18 is shown as a coiled spring having a compressed connecting end 56 and a extending portion 58. Compressed connecting end 56 is created by abutting a plurality of coil members 60 such that the coil members 60 define an internal coil path comparable to the geometry of male extension threads 54 of fastener 16 shown and described in reference to FIG. 6. Extending portion 58 includes a plurality of spaced coil members 62 spaced for example as shown between exemplary coil members 62', 62", 62''' which allows for axial deflection of the coil members 62. Extending portion 58 can have an extending portion length "D", and compressed connecting end 56 can have a compressed connecting end length "E" which is approximately equal to extension length "C" of reduced diameter shank extension 52. A connecting end internal diameter "F" is provided by the coils of abutting coil members 60, which approximates a root diameter of the male extension threads 54 of fastener 16.

Figure 9:
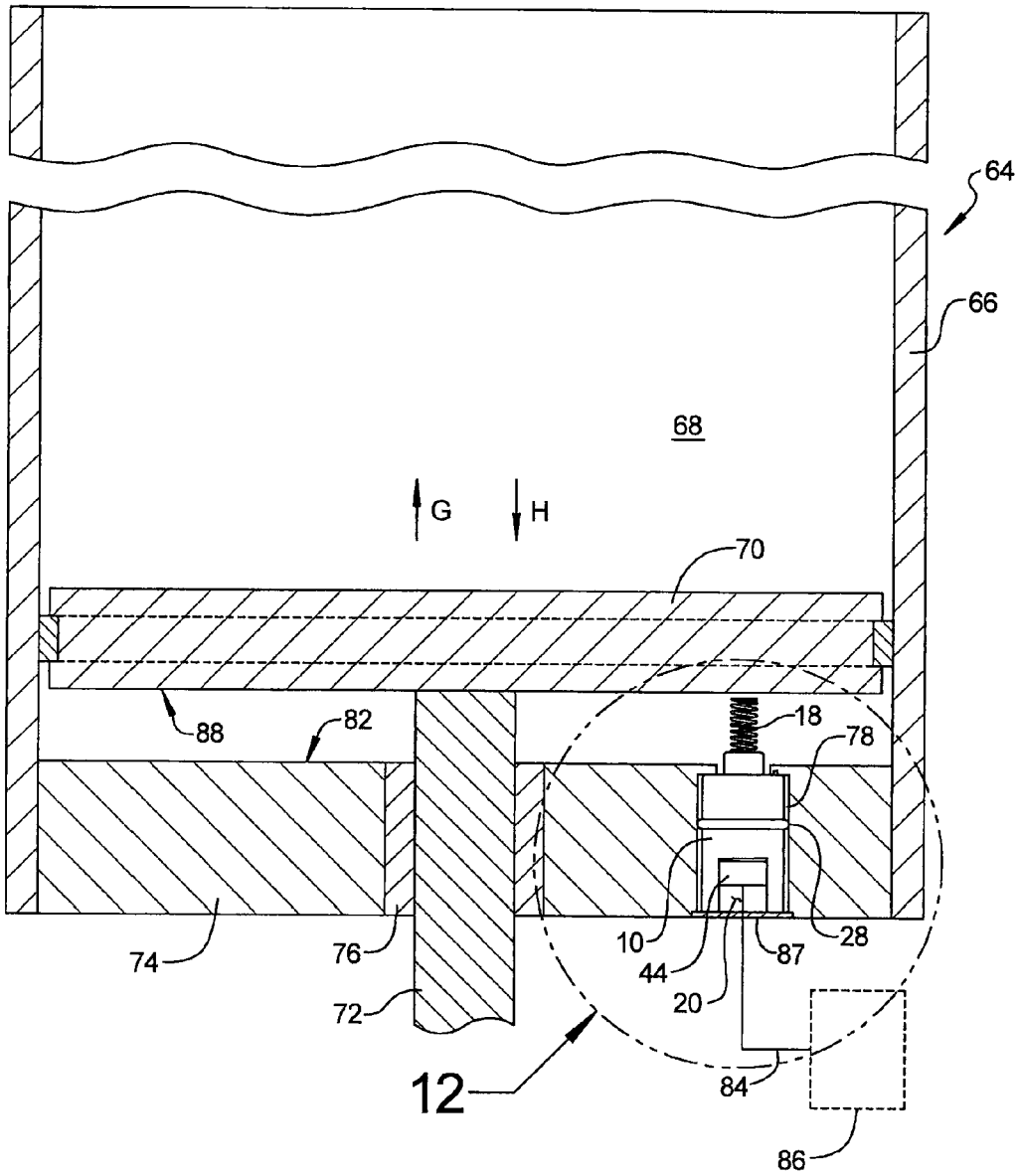
FIG. 9 is a partial cross sectional front elevational view of a piston assembly having the electrical contact device of FIG. 1 installed therein.

Referring to FIG. 9, one exemplary application of electrical connector assembly 10 can be in conjunction with a piston assembly 64. Piston assembly 64 includes a cylinder 66 defining a piston chamber 68 having a piston 70 slidably disposed within piston chamber 68 such that piston 70 can slide in either of a piston return path "G" or a piston drive path "H". One or more seals can be disposed about an outer perimeter of piston 70 as known in the art to provide a pressure containment seal between piston 70 and an inner wall defined by cylinder 66. A piston rod 72 is connected to piston 70 and extends transversely away from piston 70. As piston 70 moves in either of the piston return path "G" or the piston drive path "H", piston rod 72 is slidably moved through a cylinder end wall 74 having an electrically conductive material bearing/seal 76 creating a pressure containing boundary for piston rod 72 and piston chamber 68.

Electrical connector assembly 10 can be slidably received within a connector receiving bore 78 created in cylinder end wall 74. With electrical connector assembly 10 positioned as shown having biasing element 18 extending into piston chamber 68 and toward piston 70, the at least one connector seal member 28 such as a rubber or an elastomeric material O-ring provides a pressure containment seal between electrical connector assembly 10, connector receiving bore 78, and piston chamber 68. A portion of biasing element 18 extends freely from electrical connector assembly 10 and is the only portion of electrical connector assembly 10 positioned within piston chamber 68, having a portion of biasing element 18 extending freely away from an end wall interior face 82 of cylinder end wall 74.

Figure 10:
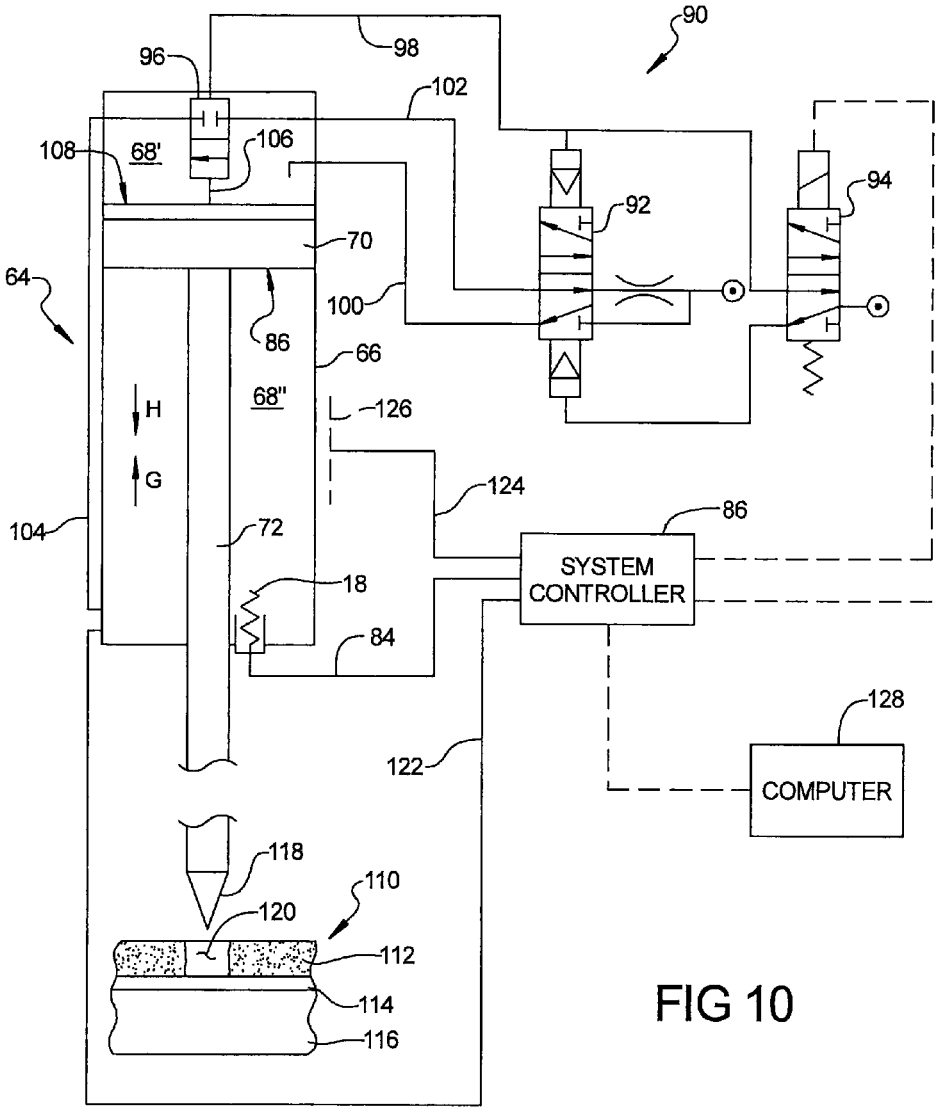
FIG. 10 is a diagrammatic representation of a control system incorporating the electrical contact device of FIG. 1.
Figure 11:
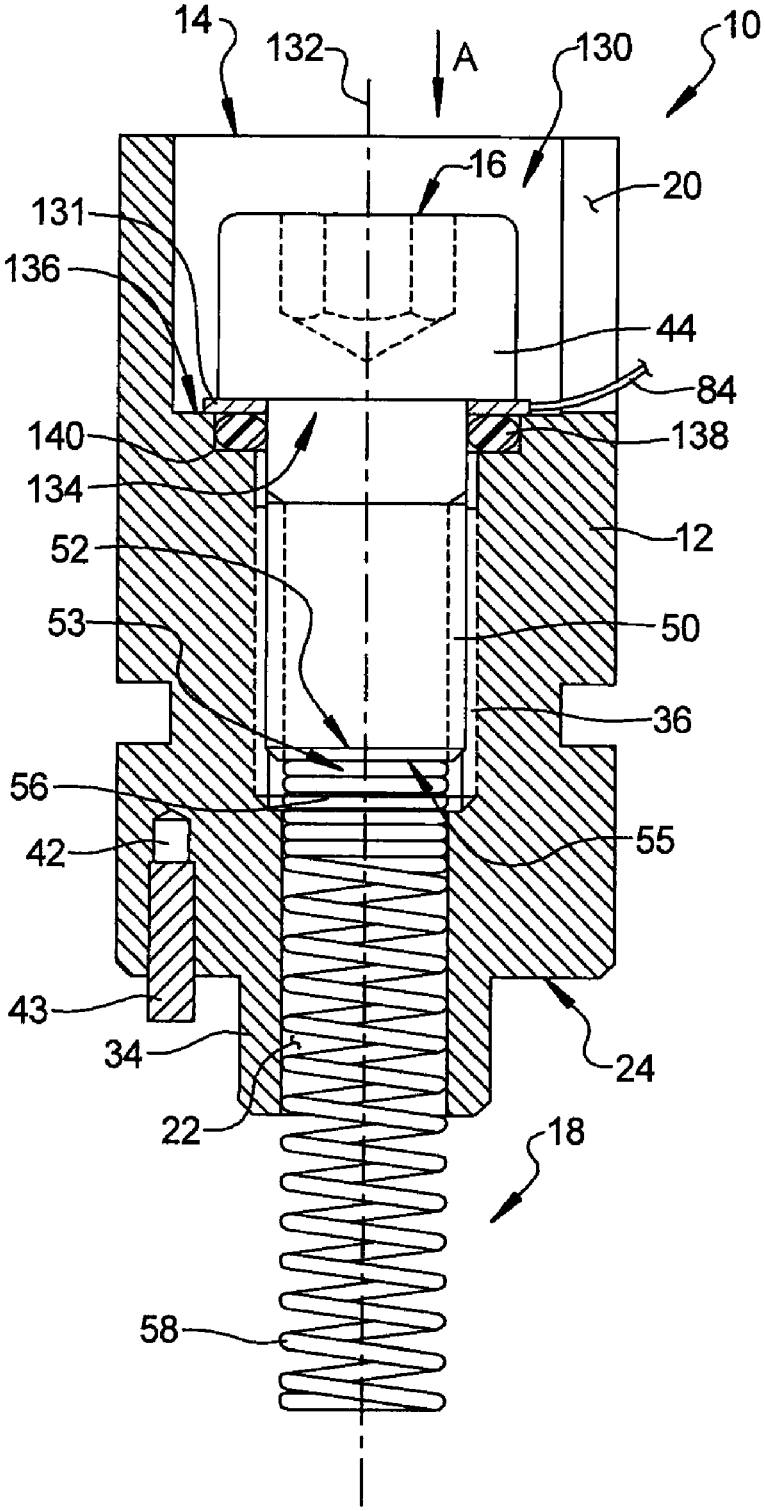
FIG. 11 is a partial cross sectional front elevational view of the electrical contact device of FIG. 1.

An electrical conductor 84 is connected for example by soldering or mechanically connected for example by crimping directly to fastener 16 or by use of a connector that is shown and described in reference to FIG. 11 such that electrical conductor 84 extends through access cavity 20 of electrical connector assembly 10. An opposite end of electrical conductor 84 is connected to a system controller 86 which will be described in reference to FIG. 10. Electrical connector assembly 10 can be retained within connector receiving bore 78 against the pressure within piston chamber 68 using a mechanical connector such as a deflectable clamp ring 87 which engages against the inner wall defined by connector receiving bore 78 to mechanically retain electrical connector assembly 10 within connector receiving bore 78. With the electrical connector assembly 10 and biasing element 18 positioned as shown, biasing element 18 is electrically isolated from cylinder end wall 74 by the material of tubular body 12, and an electrical circuit is completed when a first piston surface 88 contacts biasing element 18. The electrical circuit is partially formed through a path including piston rod 72, piston 70, biasing element 18, fastener 16, and electrical conductor 84 which is connected to system controller 86. Completion of the electrical circuit is therefore not dependent upon a mechanical switch or displacement of a contact member, but only requires physical contact between first piston surface 88 and biasing element 18. To permit piston 70 and piston rod 72 to be part of the electrical circuit, these components are made from an electrically conductive material.

Referring now to FIG. 10, an operating system 90 using electrical connector assembly 10 and piston assembly 64 can be used in conjunction with a supply of a pressurized fluid such as air to direct the displacement of piston 70 and piston rod 72, with piston 70 able to move into contact with biasing element 18. Operating system 90 can include a first control valve 92 and a second control valve 94 which are connected to a source of pressurized air and which direct the pressurized air into the piston chamber 68 to displace piston 70. A mechanically actuated valve 96 can also be provided which is actuated when piston 70 is in a first portion 68' of piston chamber 68.

A control pressure line 98 connected between each of first and second control valves 92, 94 and mechanically actuated valve 96 provides control pressure to each of these valves. A piston drive supply line 100 is connected to first control valve 92 and discharges into the first portion 68' of piston chamber 68 above piston 70 as shown in reference to FIG. 10. Discharge of air via piston drive supply line 100 into piston chamber 68 therefore directs piston 70 in the piston drive path "H". A piston return supply line 102 is connected between first control valve 92 and mechanically actuated valve 96. A piston return connecting line 104 is then connected between mechanically actuated valve 96 and a second portion 68" of piston chamber 68 to direct the source of air to the second portion 68" of piston chamber 68 which is operable to move piston 70 in the piston return path "G". Second control valve 94 receives operating commands from system controller 86 for directing pressurized air into either first or second portion 68', 68" of piston chamber 68.

With piston 70 shown in the furthest upward extended position, an actuator 106 of mechanically actuated valve 96 is contacted by a second piston surface 108. This physical contact with actuator 106 stops the flow of pressurized air within piston return connecting line 104 into second portion 68" of piston chamber 68, therefore stopping the upward motion and establishing an upper travel limit of piston 70. Conversely, when piston 70 is oppositely positioned from that shown and first piston surface 88 contacts biasing element 18 of electrical connector assembly 10, an electrical circuit is completed through electrical conductor 84 to system controller 86 which directs second control valve 94 and therefore first control valve 92 to stop flow of the pressurized air through piston drive supply line 100 into the first portion 68' of piston chamber 68. Contact between piston 70 and biasing element 18 therefore results in a lower travel limit for the position of piston 70 within cylinder 66, and therefore also establishes a maximum outward displacement of piston rod 72. Some overshoot of piston 70 can occur due to momentum of the parts, therefore circuit closure from contact between piston 70 and biasing element 18 provides an approximate lower travel limit for piston 70 and additional length of exposed biasing element 18 is provided to allow for some compression due to this motion.

The displacement of piston 70 and piston rod 72 can be used in conjunction with electrical connector assembly 10 to help control the feeding of material into an aluminum processing bath 110. Aluminum processing bath 110 can develop a crust 112 of hardened, generally non-electrically conductive material which forms by cooling. Crust 12 is located above a mixture 114 containing alumina film and electrically conductive molten aluminum which occurs between crust 112 and purely molten aluminum layer 116. During operation of the aluminum processing bath 110, it is desirable to add alumina material normally in the form of a non-conductive powder by using a chisel end 118 of piston rod 72 to break through crust 112 creating a crust aperture 120. By periodically displacing chisel end 118 through crust aperture 120 the crust aperture 120 is maintained to allow recharging of the alumina material through crust aperture 120 to create mixture 114.

During normal operation of aluminum processing bath 110, a first voltage is present in molten aluminum layer 116. When chisel end 118 of piston rod 72 breaks through crust 120 and contacts either or both of mixture 114 and molten aluminum layer 116, the voltage of aluminum processing bath 110 creates a current flow through piston rod 72 to system controller 86. When current flow is sensed by system controller 86 the flow of pressurized fluid into cylinder 66 is stopped to stop the travel of piston rod 72 toward aluminum processing bath 110, and pressurized fluid is directed into cylinder portion 68" to retract piston rod 72. Under normal operating conditions, physical contact between chisel end 118 of piston rod 72 and mixture 114 and/or molten aluminum layer 116 is sufficient to close the electrical circuit using system controller 86 to stop further flow of pressurized air via piston drive supply line 100 into cylinder 66. If chisel end 118 becomes corroded or layered with non-conductive material of crust 112, contact of chisel end 118 with mixture 114 or molten aluminum layer 116 will not close the electrical circuit and current flow will not be sensed by system controller 86. If this occurs, electrical connector assembly 10 provides an alternate or secondary path to complete the electrical circuit through system controller 86 to redirect flow of the pressurized air into cylinder 66 to force piston 70 to return by piston return path "H".

System controller 86 operates by sensing current flow due to the operating voltage of aluminum processing bath 110 which defines the first circuit voltage. When contact between chisel end 118 and alumina film 114 or molten aluminum layer 116 is insufficient to close the electrical circuit with system controller 86, contact between first piston surface 88 of piston 70 and biasing element 18 closes the secondary circuit via electrical conductor 84 and system controller 86. The secondary voltage, which can be the same or a different voltage than the first voltage of aluminum processing bath 110 is sensed by current flow to system controller 86. Sensing of the second voltage also indicates that chisel end 118 is in contact with mixture 114 and/or molten aluminum layer 116 based on a predetermined maximum displacement of piston 70 defined when piston 70 contacts biasing element 18.

A first connecting line 122 electrically connects cylinder 66 to system controller 86. A structural voltage path line 124 connected to a piston assembly structure 126 is used to provide the remaining electrical circuit path for the first or primary circuit between system controller 86, piston 70, and piston rod 72.

The secondary electrical circuit which includes electrical connector assembly 10 is created between system controller 86, structural voltage path line 124, piston assembly structure 126, piston 70, biasing element 18 and fastener 16 of electrical connector assembly 10, and electrical conductor 84. Referring again to FIG. 1, because biasing element 18 and fastener 16 are electrically isolated from cylinder 66 by tubular body 12, the secondary electrical circuit is only closed when piston 70 contacts biasing element 18. The primary electrical circuit includes system controller 86, structural voltage path line 124, piston assembly structure 126, piston 70, piston rod 72, mixture 114 and/or molten aluminum layer 116, and baseline voltage line 122. A computer 128 or similar processor can also be provided with operating system 90 which can be used to direct operation of system controller 86 such as to provide delay operating times, increased or decreased voltages, and/or to determine a period between operations of piston 70 and piston rod 72 to maintain the crust aperture 120 through crust 112.

Referring to FIG. 11 and again to FIG. 6, the components of electrical connector assembly 10 can include the following. A fastener/biasing element sub-assembly 130 is first created by rotating compressed connecting end 56 of biasing element 18 into threaded engagement with reduced diameter shank extension 52 (only partially visible in this view) of fastener 16. Compressed connector end 56 can be threadably rotated for example in a counter-clockwise or left hand direction until compressed connecting end 56 contacts a compressible element 53 such as an O-ring which can be positioned between compressed connecting end 56 and end face 55 of fastener 16. Compressible element 53 can be used to create a tension force between compressed connecting end 56 and end face 55 of fastener 16 to help retain biasing element 18. Compressible element 53 can be omitted when compressed connecting end 56 forms a connection with end face 55 of fastener 16 that resists rotational release. The male extension threads 54 of fastener 16 can also be provided as right-hand threads adapted to receive compressed connector end 56 using a clockwise rotation. A conductive member such as a conductive ring 131 is slidably disposed over shank 48 and male shank threads 50 to contact head 44 of fastener 16. The fastener/biasing element sub-assembly 130 is then inserted in the insertion direction "A" into open receiving end 14 of tubular body 12 until extending portion 58 is received within biasing element bore 22.

Fastener head 44 is thereafter rotated (using a tool such as an alien wrench) to threadably engage male shank threads 50 of fastener 16 with internal threaded bore 36 of tubular body 12. Fastener 16 is axially received on an assembly longitudinal axis 132 and is rotated until a conductive ring surface 134 of conductive ring 131 contacts a bore end surface 136 created in tubular body 12. At this time, a portion of extending portion 58 freely extends through and beyond boss 34 of tubular body 12. Boss 34 thereafter provides support to maintain biasing element 18 substantially coaxially aligned with assembly longitudinal axis 132. Electrical connector assembly 10 can therefore be disassembled by using an opposite rotation of fastener 16 for example to allow removal and replacement of biasing element 18.

A pressure containment seal is created by positioning a fastener seal member 138 such as an elastomeric O-ring in a circumferential slot 140 created in tubular body 12 proximate to bore end surface 136. Seal member 138 is compressed by contact with conductive ring surface 134, shank 48, and a surface defined by circumferential slot 140. To provide for connection of electrical conductor 84 and fastener 16, electrical conductor 84 is connected for example by soldering or swaging to conductive ring 131. Electrical conductor 84 then passes through access cavity 20. Anti-rotation pin 43 is connected to tubular body 12 at perimeter aperture 42 using a threaded connection, a frictional fit connection, or a similar mechanical connection to retain anti-rotation pin 43. Anti-rotation pin 43 extends away from end face 24 by a height which is less than a height of boss 34 determined with respect to end face 24.

Figure 12:
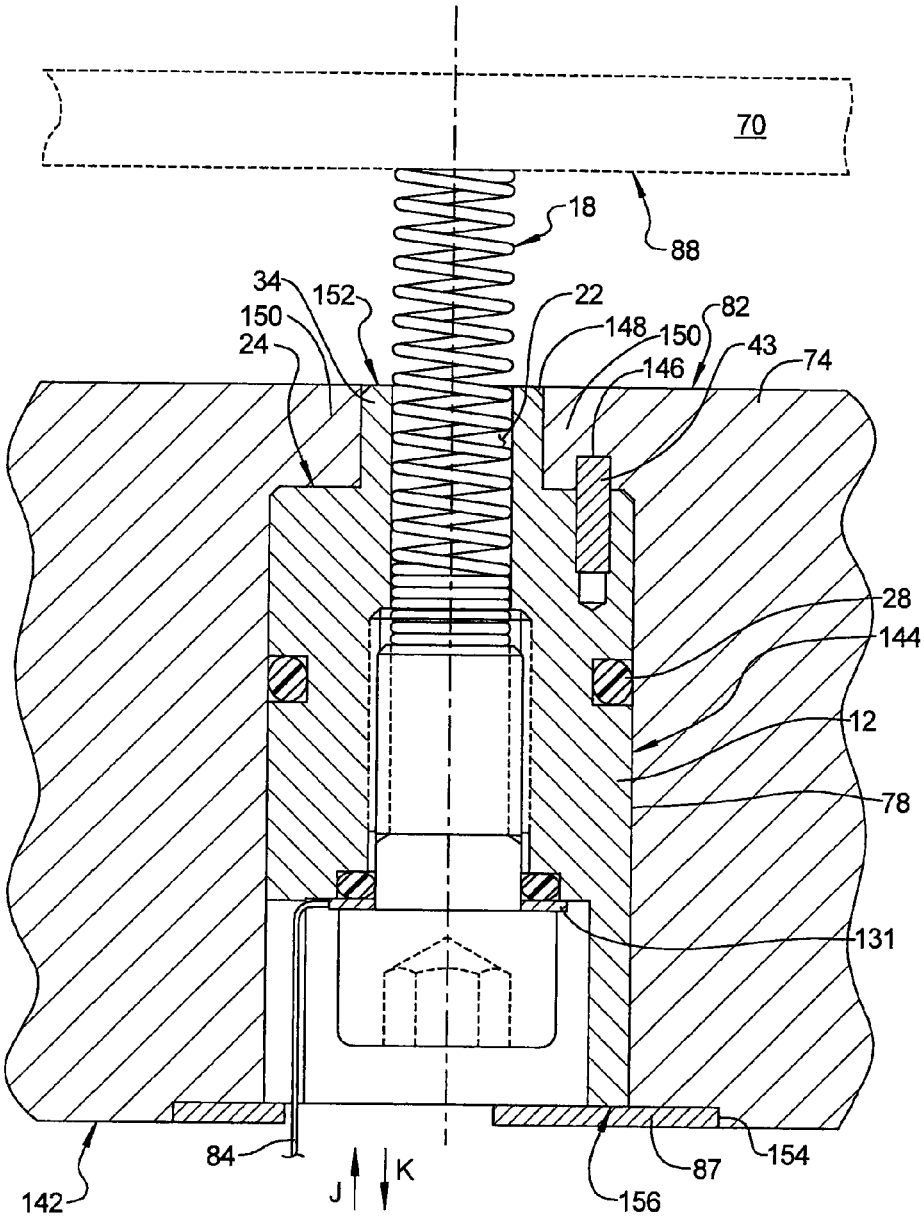
FIG. 12 is a cross sectional front elevational view of the electrical contact device shown connected to an end wall of a piston cylinder.

Referring to FIG. 12, the connection of electrical connector assembly 10 to cylinder end wall 74 is made as follows. Connector receiving bore 78 opens at an end wall exterior face 142 of cylinder end wall 74. Electrical connector assembly 10 is slidably inserted in an insertion direction "J" into connector receiving bore 78 such that seal member 28 is engaged against an inner wall 144 and until anti-rotation pin 43 is received in a blind pin receiving aperture 146. Insertion of anti-rotation pin 43 into pin receiving aperture 146 thereafter prevents axial rotation of electrical connector assembly 10 within connector receiving bore 78. At this time, boss 34 is received within a clearance bore 148 which is smaller in diameter than a diameter of connector receiving bore 78. Clearance bore 148 creates a shoulder portion 150 of end wall 74.

A free end 152 of boss 34 is positioned within clearance bore 148 and even with or below end wall interior face 82 so that no portion of boss 34 extends above end wall interior face 82 which could be impacted by piston 70. When end face 24 of tubular body 12 abuts against shoulder portion 150, the clamp ring 87 can be biased into engagement with the outer wall of a ring receiving counterbore 154 such that clamp ring 87 contacts a surface 156 at the open receiving end 14 of tubular body 12 to prevent displacement of electrical connector assembly 10 in a removal path "K" unless clamp ring 87 is removed.

Referring to FIGS. 13 through 15, and again to FIGS. 9 and 12, according to further embodiments a cylinder end wall 158 is modified from cylinder end wall 74 to include a raised ring 160 adapted to receive a cylinder 162 (partially shown in phantom). A connector receiving bore 164 is provided similar to connector receiving bore 78. A clearance bore 166 is provided to receive boss 34 of electrical connector assembly 10 (not shown in these views). A ring receiving counterbore 168 is provided to receive a clamp ring 87 (not shown in these views). A conductor passage bore 170 is oriented transverse to and opens into connector receiving bore 164. The access cavity 20 of tubular body 12 of electrical connector assembly 10 (not shown in these views) is aligned with conductor passage bore 170 to provide an alternate path for electrical conductor 84. Connector receiving bore 164 and conductor passage bore 170 are located in a plate 172 such that conductor passage bore 170 opens through a side wall 174.

It is noted items of the present disclosure can be modified without departing from the scope of the present disclosure. If the biasing element bore 22 is increased to approximately the size of the shank 48, the reduced diameter shank extension 52 can be deleted allowing a modified compressed connecting end 56 of biasing element 18 to be threadably engaged directly with shank threads 50 of fastener 16. Additional deflectable devices can also be substituted for the coiled spring design described herein for biasing element 18, such as a deflectable beam, or a bendable or looped shaft. Fastener 16 can also be connected to tubular body 12 without threads, using for example a press fit, an adhesive connection, a barbed or hooked connection, and the like.

An electrical connector assembly 10 of the present disclosure offers several advantages. By threading a fastener 16 into an electrically insulating tubular body 12 and extending a deflectable biasing element 18 from fastener 16, an electrical path can be created through fastener 16 by contact with biasing element 18. Further deflection of biasing element 18 can also be accommodated due to the free length of biasing element 18 that extends away from tubular body 12. A conductor can be connected between biasing element 18 and fastener 16 which can be led through an aperture of fastener 16 for remote connection. An anti-rotation pin 43 provided with tubular body 12 precludes axial rotation of electrical connector assembly 10. A seal member located in a circumferential or perimeter slot in tubular body 12 allows electrical connector assembly 10 to form a portion of a pressure boundary, such as a cylinder of a piston assembly. In this application, the biasing element 18 can complete an electrical circuit by contact with a piston 70, without deflection of biasing element 18, thereby obviating the need for a displaceable mechanical switch. The biasing element 18 can also include a plurality of coils defining a compressed connecting end that can be threadably connected to the fastener, providing a robust yet releasable connection.

Referring to FIG. 16 and again to FIG. 1, an electrical connector assembly 200 is modified from electrical connector assembly 10 and can be used in similar applications, therefore the differences will be further described. Electrical connector assembly 200 includes an electrically insulating body 202 which can be tubular in shape or other geometric shapes, having an open fastener nut receiving end 204 through which is received a fastener 206 (shown and described in reference to FIG. 17). A biasing element 208 is similar to biasing element 18, such as a coiled compression spring, being electrically and mechanically connected to the fastener 206 and extending outwardly of a reduced diameter portion 210 of tubular body 202. An access cavity 212 is provided in a wall of tubular body 202 proximate to nut receiving end 204 to provide access to fastener 206 to extend an electrical connector 214 electrically connected to fastener 206. The biasing element 208 extends partially through and outwardly from a biasing element extension end 216 which is created through an end of reduced diameter portion 210 of tubular body 202. Biasing element extension end 216 is oppositely positioned and directed with respect to fastener nut receiving end 204.

Figure 16:
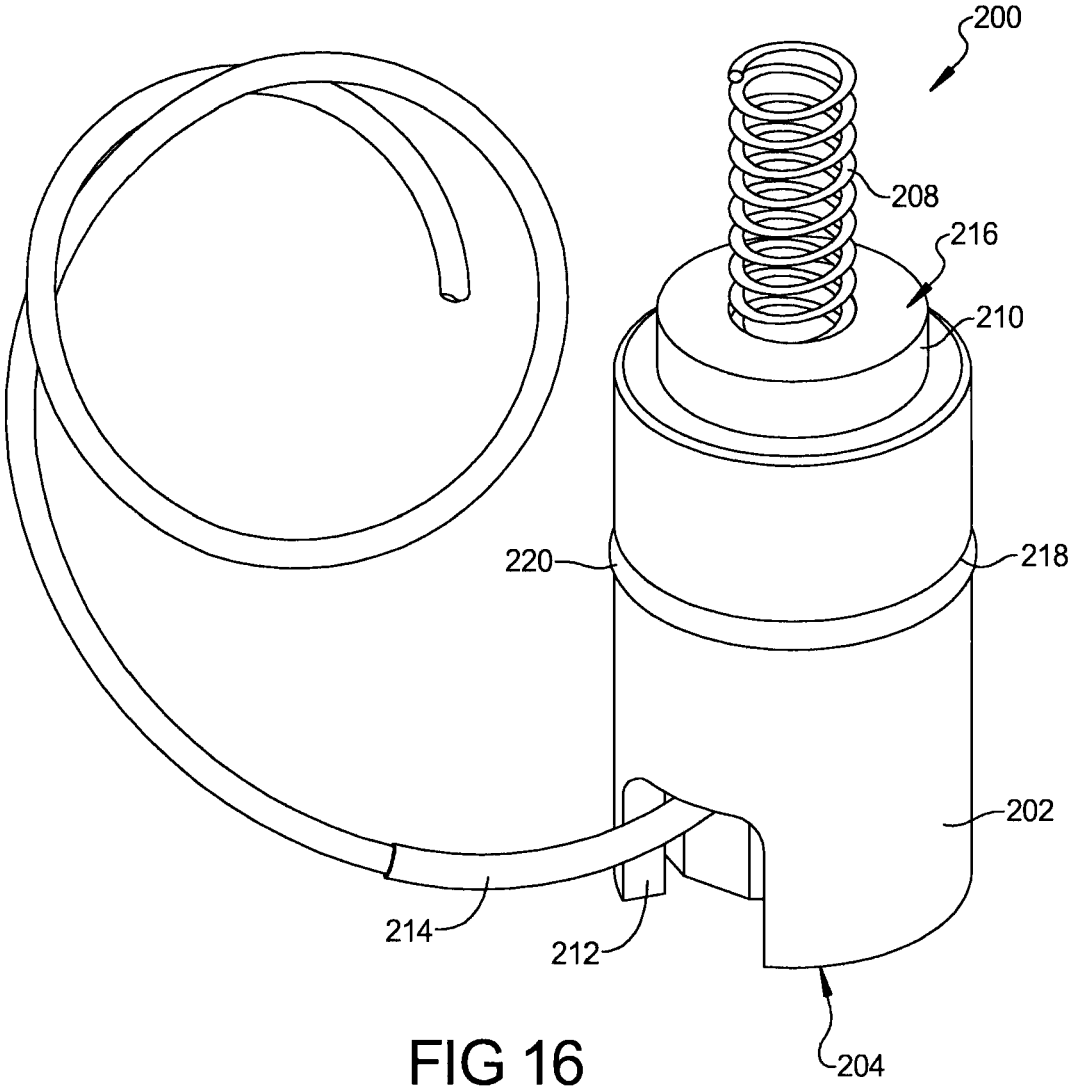
FIG. 16 is a front perspective view of another embodiment for a pneumatic system electrical contact device.

According to several embodiments, a seal is provided with tubular body 202 so tubular body 202 can form a portion of a pressure boundary similar to electrical connector assembly 10. Similar to electrical connector assembly 10, the seal can be formed as a flange extending from the tubular body, an O-ring seated about the tubular body 202, a raised surface of the tubular body 202, or the like. According to several embodiments and as shown in FIG. 16, at least one perimeter or circumferential slot 218 is provided in tubular body 202 which is sized to receive a seal member 220 such as an elastomeric O-ring or D-ring. As noted above, circumferential slot 218 can be eliminated and seal member 220 can be formed as a protuberance, flange, or extension of tubular body 202.

Figure 17:
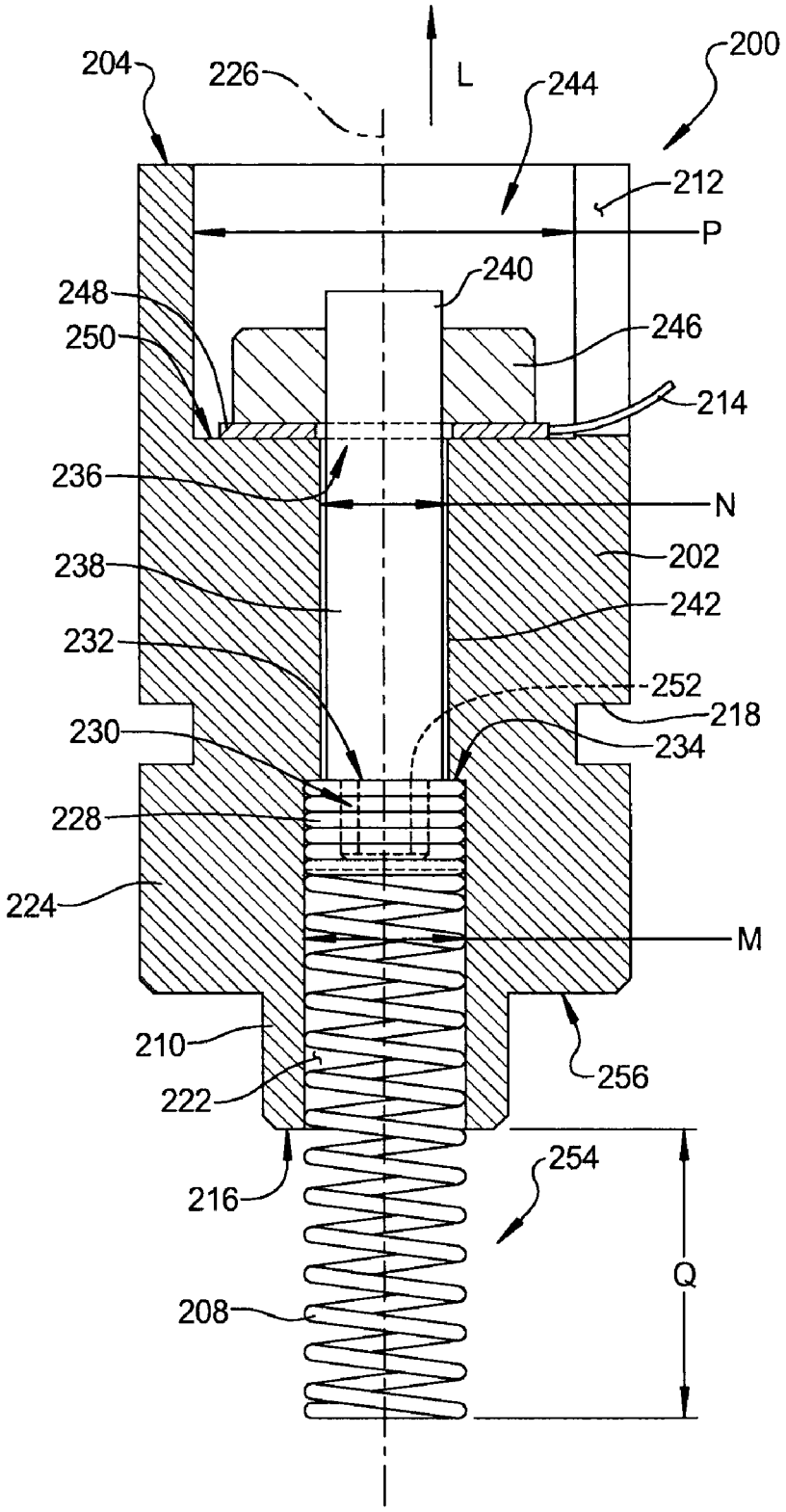
FIG. 17 is a partial cross sectional front elevational view of the electrical contact device of FIG. 16.

Referring to FIG. 17, fastener 206 and biasing element 208 are first connected and then together assembled into tubular body 202 in an insertion direction "L" through a longitudinal first bore 222. Longitudinal first bore 222 is created through biasing element extension end 216 and extends through reduced diameter portion 210 and partially into an enlarged diameter portion 224 of tubular body 202. Longitudinal first bore 222, reduced diameter portion 210 and enlarged diameter portion 224 are coaxially aligned with a longitudinal axis 226 of electrical connector assembly 200. According to several embodiments, biasing element 208 includes a compressed coiled end 228 which is threadably connected onto and exterior of a plurality of threads of a male threaded head 230 of fastener 206 such that both fastener 206 and biasing element 208 can be together loaded into longitudinal first bore 222 at the same time in the insertion direction "L". Fastener 206 and biasing element 208 are together inserted into longitudinal first bore 222 until an end face 232 of male threaded head 230 contacts a counter-bore end wall 234 of longitudinal bore 222. At the same time, a shank 236 of fastener 206 having an un-threaded portion 238 and a male threaded portion 240 are slidably received through a through second bore 242 of enlarged diameter portion 224 which is also co-axially aligned on longitudinal axis 226.

Longitudinal first bore 222 opens into through second bore 242 at one end of through second bore 242. Through second bore 242 subsequently opens into an enlarged diameter third bore 244 at an opposite end of through second bore 242. Longitudinal first bore 222 has a first diameter "M". First diameter "M" is greater than a diameter of compressed coiled end 228 after compressed coiled end 228 is threadably engaged over male threaded head 230 of fastener 206 so that biasing element 208 and fastener 206 can be together slidably received in longitudinal first bore 222. Through second bore 242 has a second diameter "N" which is smaller than first diameter "M" but larger than a diameter of shank 236 to permit sliding reception of shank 236, while at the same time preventing passage of compressed coiled end 228 and male threaded head 230 into through second bore 242. Enlarged diameter third bore 244 has a third diameter "P" which is larger than first diameter "M" and therefore also larger than second diameter "N". At least a portion of male threaded portion 240 of shank 236 extends into enlarged diameter third bore 244.

Third diameter "P" of enlarged diameter third bore 244 is selected to permit a nut 246 to be received and rotated or held in position within enlarged diameter third bore 244 as threaded portion 240 of shank 236 is threadably connected with nut 246. Nut 246 directly contacts a connector fitting 248 of electrical connector 214. Connector fitting 248 in turn directly contacts a counter-bore end face 250 defining a terminal end of enlarged diameter third bore 244. Fastener 206 can be threadably engaged with nut 246 by insertion of a tool (not shown) such as a hexagonal wrench into a wrench engagement slot 252 extending coaxially through male threaded head 230 and used to rotate fastener 206. In the installed position of fastener 206 and biasing element 208, a non-compressed coil end 254 freely extends away from both biasing element extension end 216 and a shoulder 256 of enlarged diameter portion 224. In a non-compressed condition (shown) of coil end 254, an extension dimension "Q" is provided which can vary at the discretion of the manufacturer.

A material of tubular body 202 is selected from an electrically non-conductive material, which according to several embodiments can be a polymeric material such as a polytetrafluoroethylene, a perfluoroalkoxy material, or a fluorinated ethyleneproplylene material. The material for tubular body 202 is selected both for its temperature resistance and for its ability to provide electrical insulation properties and is not limited to the materials listed above. According to several embodiments, fastener 206 is made from an electrically conductive material including a metal such as steel. Material for the biasing element 208 is also an electrically conductive material which can include a metal such as stainless steel including 1700 stainless steel. According to several embodiments, biasing element 208 is in the form of a coiled compression spring, however biasing element 208 can be provided in other forms that allow for axial or longitudinal deflection/compression.

Figure 18:
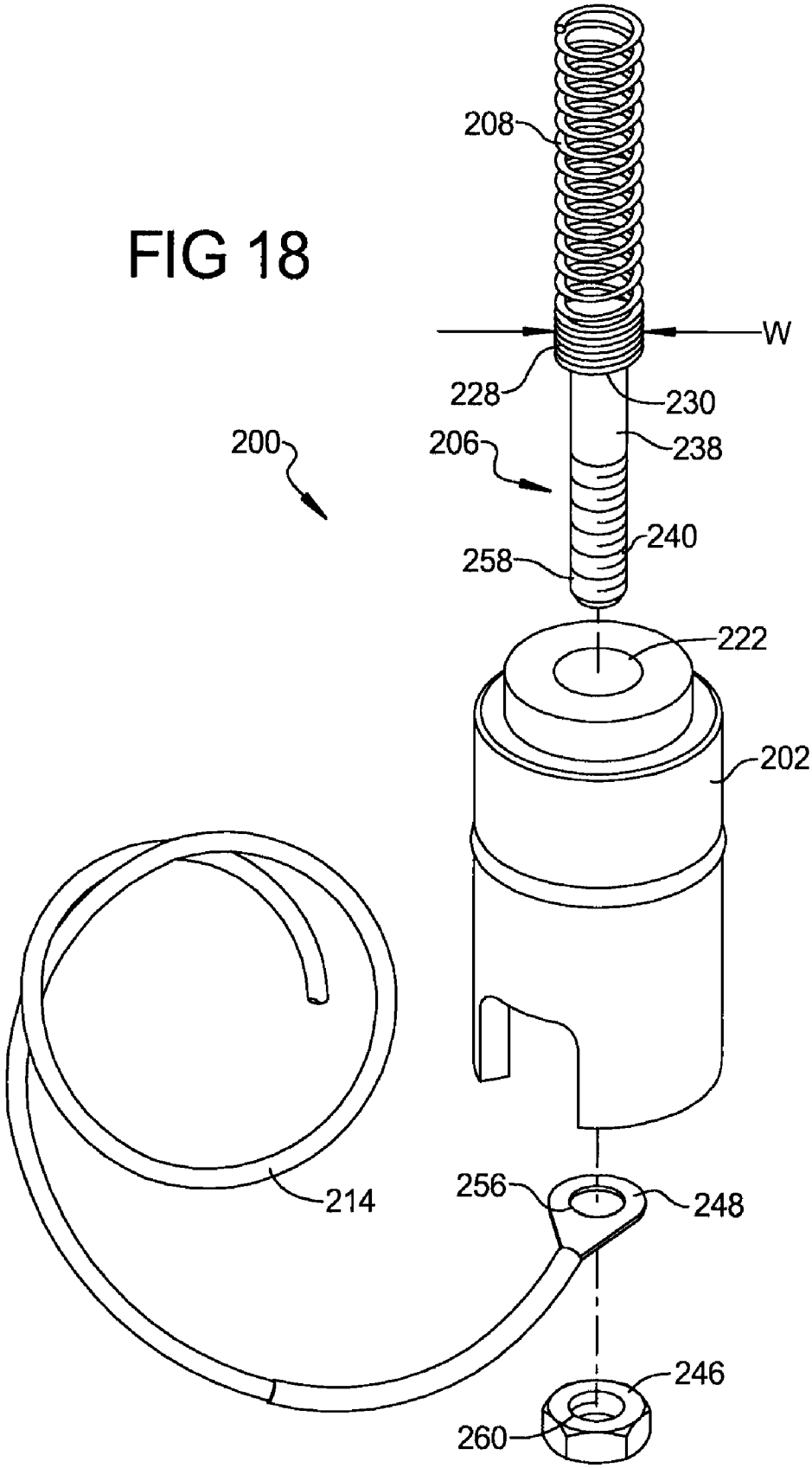
FIG. 18 is an exploded front perspective view of the electrical contact device of FIG. 16.

Referring to FIG. 18 and again to FIG. 17, biasing element 208 has its compressed coiled end 228 threadably coupled to male threaded head 230 of fastener 206. The first diameter "M" of longitudinal first bore 222 is greater than a diameter "W" of the compressed coiled end 228 after the compressed coiled end 228 is threadably engaged over the male threaded head 230 of the fastener 206 such that the biasing element 208 and the fastener 206 can be together slidably received in the longitudinal first bore 222. An aperture 256 of connector fitting 248 of electrical connector 214 is sized to slidably receive male threaded portion 240 such that a male thread 258 of male threaded portion 240 extending past connector fitting 248 and into enlarged diameter third bore 244 can be engaged with a female thread 260 of nut 246.

Figures 13, 14:
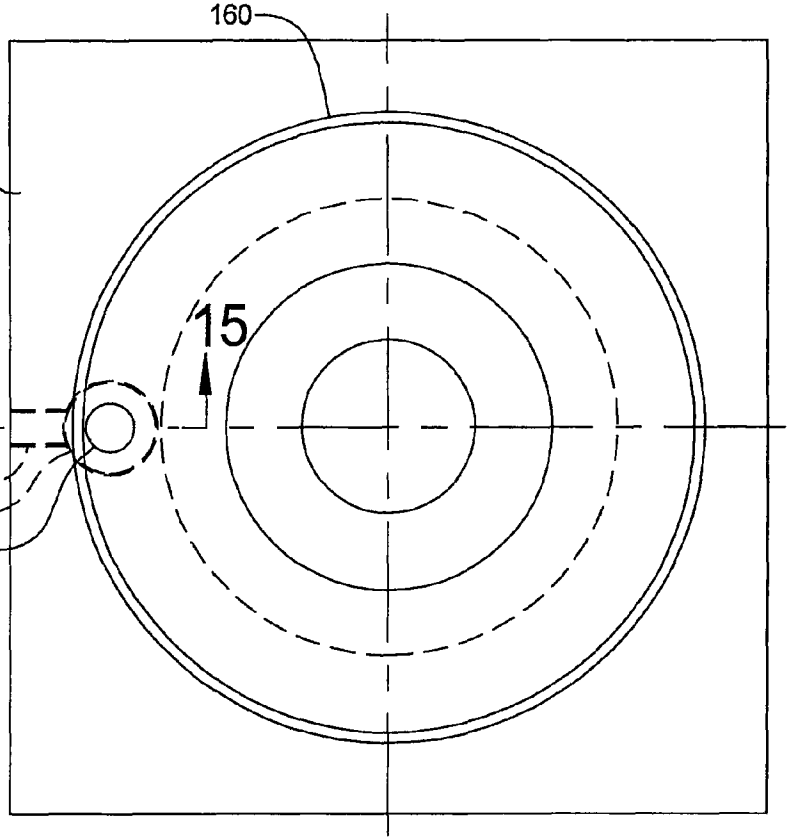
FIG. 13 is a top plan view of another embodiment of a cylinder end wall adapted to receive an electrical contact device of the present disclosure.
FIG. 14 is a front elevational view of the cylinder end wall of FIG. 13.
Figure 15:
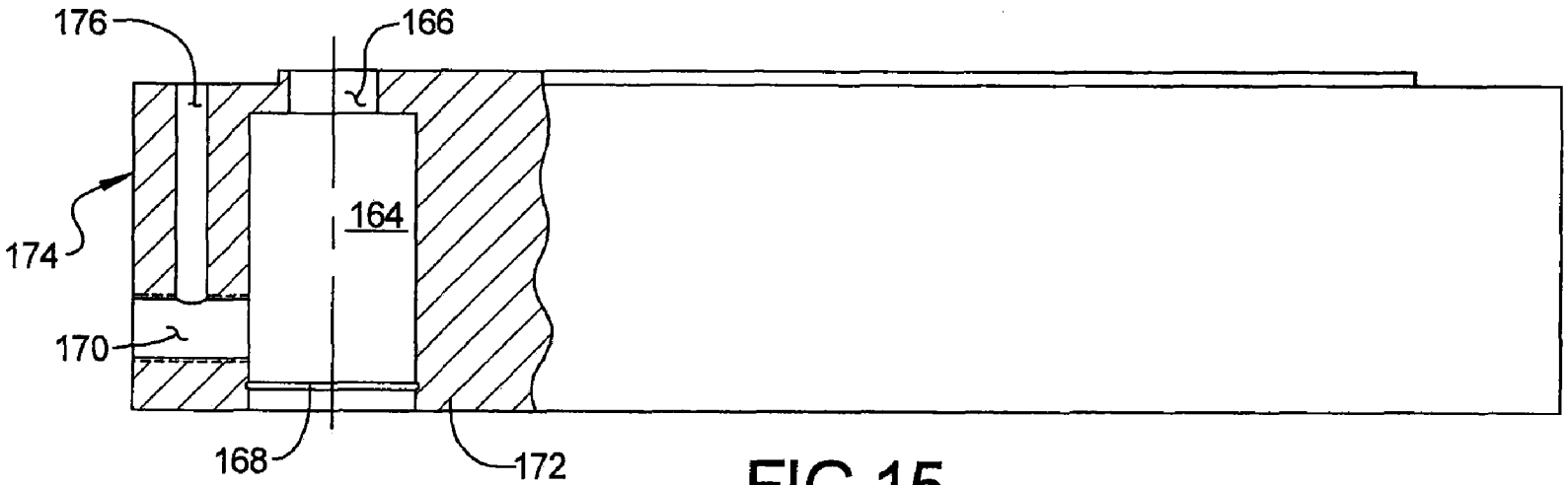
FIG. 15 is a partial cross sectional side elevational view taken at section 15 of FIG. 13.
Figure 19:
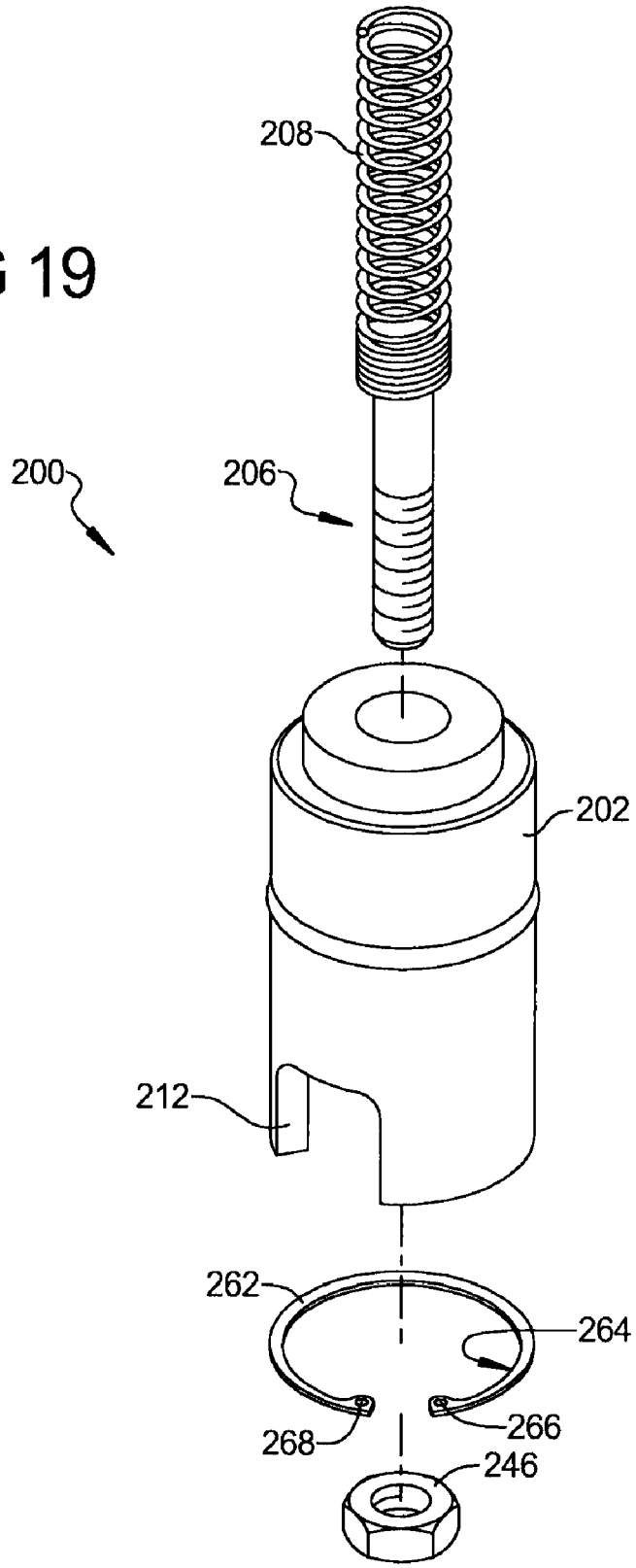
FIG. 19 is a partial exploded front perspective view of the electrical contact device of FIG. 16 further showing a C-clip retaining member.

Referring to FIG. 19 and again to FIGS. 13-15, fastener 206 and biasing element 208 can be joined as previously noted herein to nut 246. A C-shaped clamp ring 262 having ring body 264 is sized to be received in ring receiving counterbore 168 as shown in reference to FIG. 14 to act as a retainer for tubular body 202. Clip ends 266, 268 are elastically compressed toward each other as commonly known to temporarily reduce a diameter of ring body 264 during installation of clamp ring 262 in ring receiving counterbore 168.

Referring to FIG. 20 and again to FIG. 17, an electrical assembly installation/removal tool 270 includes a shaft 272 extending perpendicularly from a disk 274. Disk 274 has a geometric shape such as a circle providing for contact by an installer's finger and/or thumb. A female threaded aperture 275 is created in a free end of shaft 272 which is matched to a thread geometry of male threaded portion 240 of fastener 206 such that shaft 272 can be releasably threadably connectable using threaded aperture 275 to male threaded portion 240.

Figure 20:
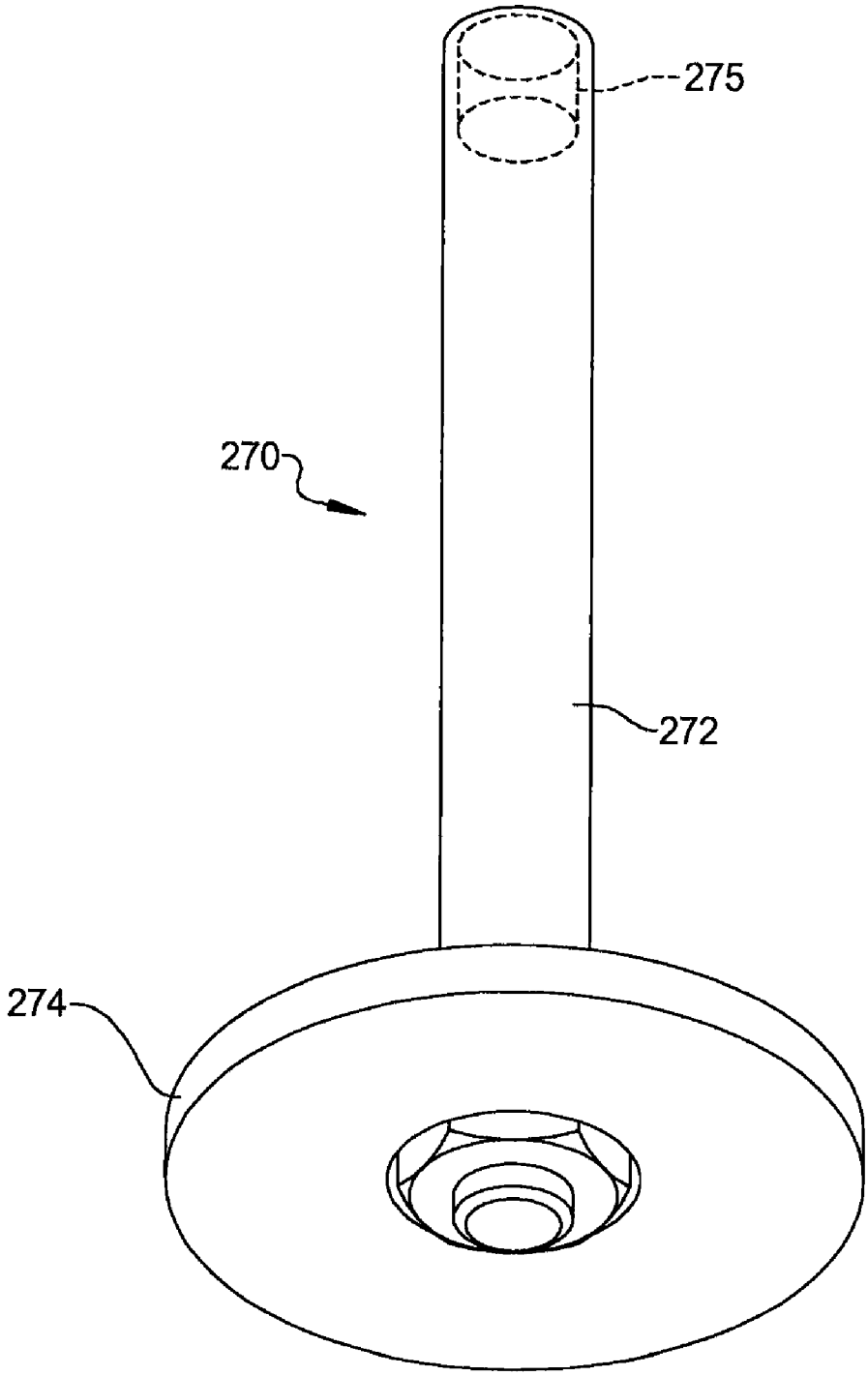
FIG. 20 is a front elevational view of an insertion/retraction tool for the electrical contact device of FIG. 16.
Figure 21:
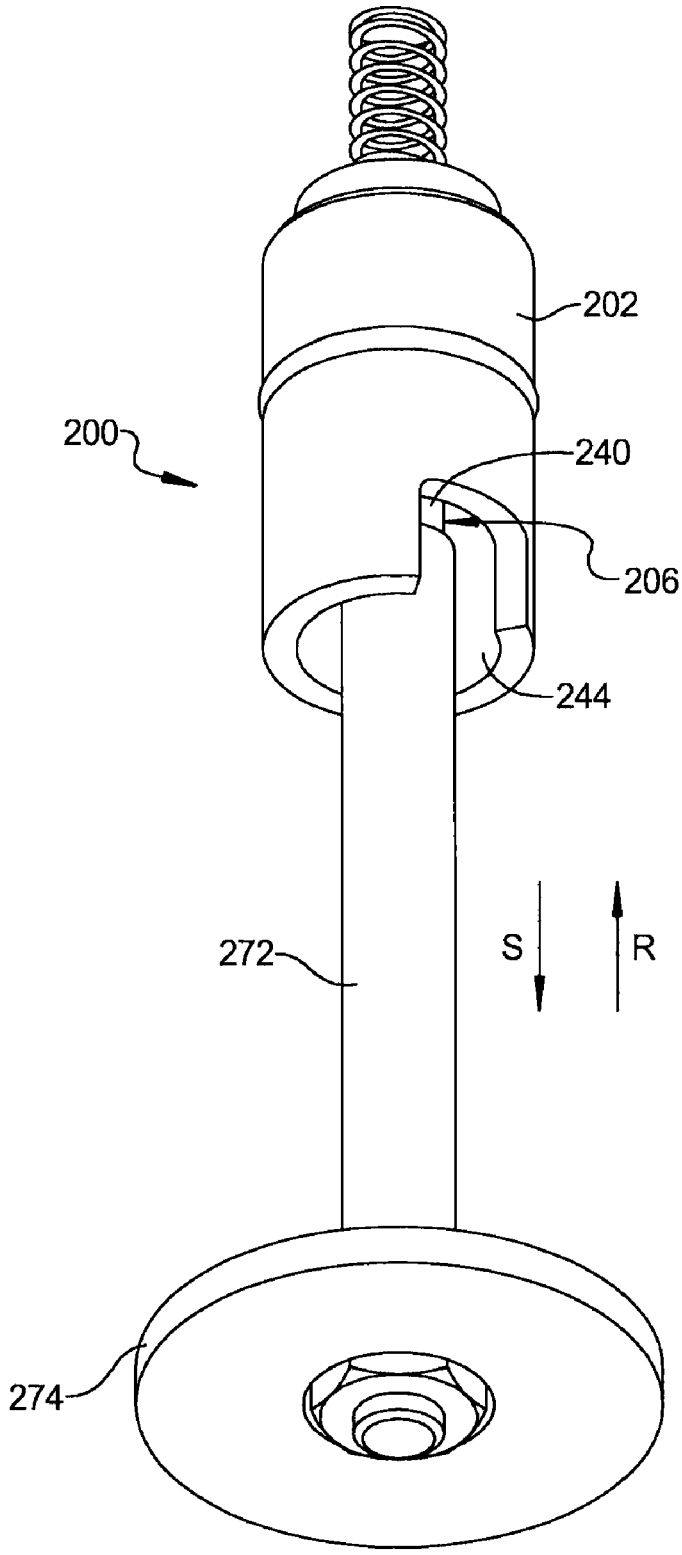
FIG. 21 is a front elevational view of the insertion/retraction tool of FIG. 20 in use with the electrical contact device of FIG. 16.

Referring to FIG. 21 and again to FIGS. 9, 17 and 20, to install and/or remove electrical connector assembly 200 in/from receiving bore 78 of cylinder end wall 74, shaft 272 is positioned as shown partially within enlarged diameter bore 244 such that threaded aperture 275 is threadably engaged to male threaded portion 240 of fastener 206, with nut 246 in its installed/tightened position. Manually applied pressure acting in an installation direction "R" on disk 274 can thereafter be applied to push electrical connector assembly 200 into connector receiving bore 78 of cylinder end wall 74. Once electrical connector assembly 200 is installed, tool 270 is oppositely axially rotated to threadably disengage threaded aperture 275 from male threaded portion 240. An opposite manually applied pressure acting in a removal direction "S" on disk 274 will pull electrical connector assembly 200 out of connector receiving bore 78 of cylinder end wall 74.

Figure 22:
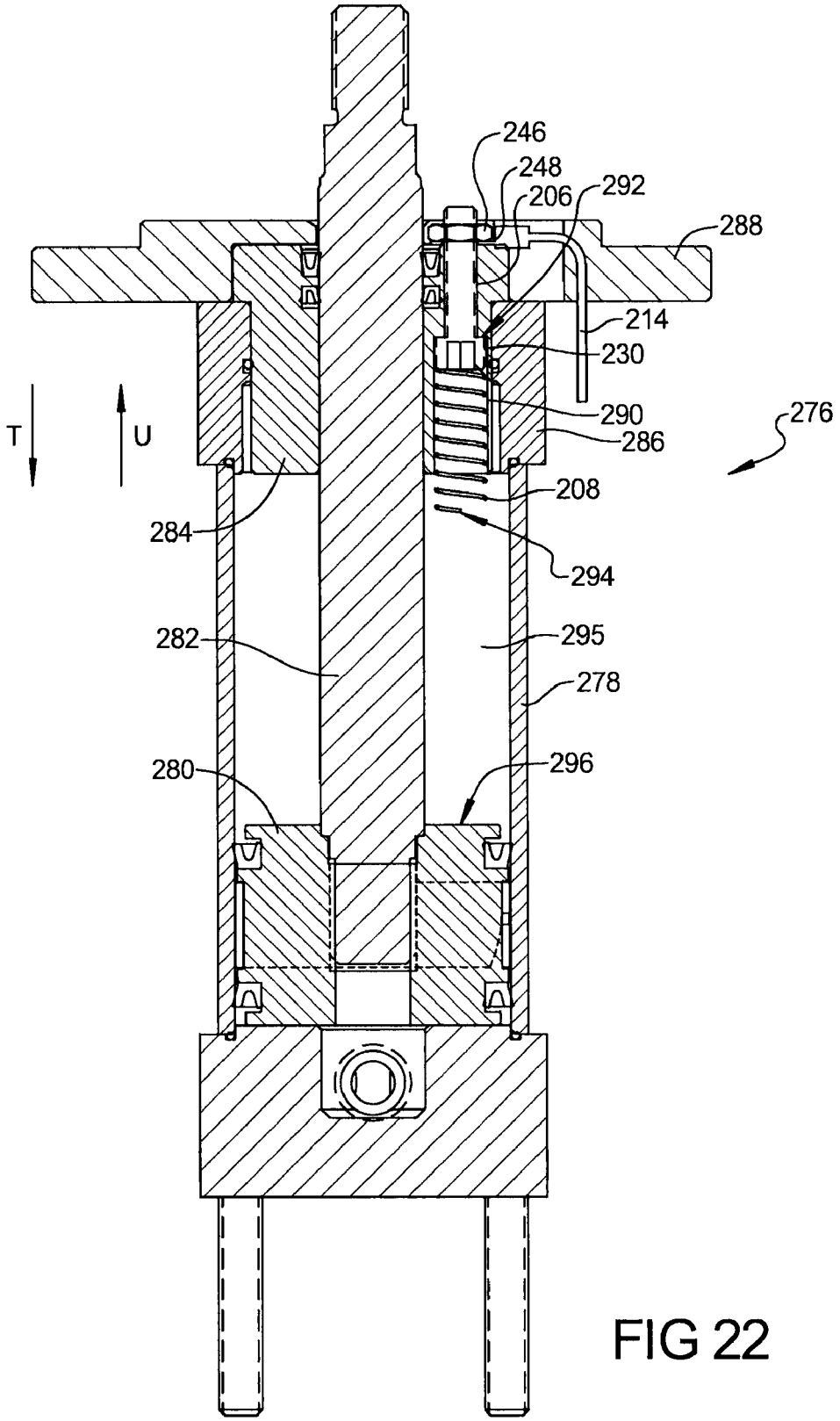
FIG. 22 is a partial cross sectional front elevational view of another embodiment for a pneumatic system electrical contact device in use in a raw material feeder device.

Referring to FIG. 22 and again to FIG. 17, according to a further embodiment a piston assembly 276 for a raw material feed tool or device has a modified electrical contact system. Piston assembly 276 includes a cylinder 278 having an electrically conductive piston 280 slidably disposed therein. Piston 280 is axially movable in cylinder 278 in each of an extension direction "T" and a contact direction "U" and displaces a piston rod 282 connected to the piston 280. Piston rod 282 is slidably received in a cylinder end wall 284 which supports and seals piston rod 282. Cylinder end wall 284 is made of a non-conductive material such as but not limited to polytetraflouroethylene, including but not limited to self lubricating materials such as Ultraflon® 500B. Cylinder end wall 284 is connected to a retaining member 286 and both the cylinder end wall 284 and retaining member 286 are in contact with and retained by a cover member 288.

The tubular body 202 of the previous embodiments is eliminated in the piston assembly 276 material feed tool embodiment such that fastener 206 and biasing element 208 are directly received in an elongated bore 290 created in cylinder end wall 284. The male threaded head 230 of fastener 206 contacts a counterbore end wall 292 of elongated bore 290 in the installed position shown. Biasing element 208 is oriented facing in the extension direction "T" and has a free end 294 extending into a piston cavity 295 of cylinder 278. Nut 246 threadably connected to fastener 206 as previously described herein retains fastener 206 in elongated bore 290. An electrical circuit is closed when piston 280 moves away from the extended position shown in the contact direction "U" until free end 294 of biasing element 208 contacts a face 296 of piston 280. The electrical circuit includes piston 280, biasing element 208, fastener 206, connector fitting 248 in direct contact with nut 246, and electrical connector 214.

What is claimed is:

1. An electrical contact device used to complete an electrical circuit, comprising:

a body of an electrically insulating material, the body including a longitudinal first bore having a first diameter, the first bore opening into a through second bore having a second diameter smaller than the first diameter, the through second bore opening into an enlarged diameter third bore having a third diameter greater than the first and second diameters;

a conductive fastener received in the body, the fastener including a male threaded head and a shank having a male threaded portion;

a conductive biasing element having an extending portion and a connecting end, the connecting end engaged onto and over the male threaded head of the fastener, the connecting end and the male threaded head slidably received in the longitudinal first bore with the shank slidably received in the through second bore such that the male threaded portion extends partially into the enlarged diameter third bore; and a nut positioned in the enlarged diameter third bore threadably engaged with the male threaded portion of the fastener to releasably couple the fastener to the tubular body having the extending portion of the biasing element extending freely out of the tubular body.

2. The electrical contact device of claim 1, further including a connector fitting of an electrical connector positioned directly between the nut and a counter-bore end face defining a terminal end of the enlarged diameter third bore.

3. The electrical contact device of claim 2, wherein an aperture of the connector fitting slidably receives the male threaded portion such that a male thread of the male threaded portion extending past the connector fitting and into the enlarged diameter third bore is releasably engaged with a female thread of the nut.

4. The electrical contact device of claim 1, wherein the longitudinal first bore, the through second bore, the enlarged diameter third bore, the reduced diameter portion, and the enlarged diameter portion are all coaxially aligned with a longitudinal axis of the electrical connector assembly.

5. The electrical contact device of claim 4, wherein the body further includes an access cavity proximate to a nut receiving end having an electrical connector connected to the nut and extending outward from the body through the access cavity.

6. The electrical contact device of claim 1, wherein the first diameter is greater than a diameter of the connecting end after the connecting end is threadably engaged over the male threaded head of the fastener such that the biasing element and the fastener are together slidably received in the longitudinal first bore.

7. The electrical contact device of claim 1, further including a wrench engagement slot extending coaxially in the male threaded head, wherein the fastener is threadably engaged with the nut by insertion of a tool into the wrench engagement slot, the tool used to rotate the fastener.

8. The electrical contact device of claim 1, wherein the shank further includes an unthreaded portion positioned within the through second bore.

9. The electrical contact device of claim 1, further including:

a shoulder defining an end of the enlarged diameter portion;

a biasing element extension end of the body extending axially past the shoulder; and a non-compressed coil end of the biasing element defining the extending portion, wherein in an installed position of the fastener and the biasing element the non-compressed coil end freely extends away from both the biasing element extension end of the body and the shoulder.

10. An electrical contact device used to complete an electrical circuit, comprising:

a body of an electrically insulating material, the body including:

a longitudinal first bore;

a through second bore opening into the longitudinal first bore;

an enlarged diameter third bore having the through second bore opening into the enlarged diameter third bore;

an electrically conductive fastener, the fastener including:

a male threaded head slid ably received in the longitudinal first bore; and a shank having a threaded portion, the shank extending perpendicular to the head and through the through second bore such that the threaded portion is positioned at least partially into the enlarged diameter third bore;

a conductive biasing element having a connecting end conductively engaged with the male threaded head, and an extending portion extending from the connecting end, the male threaded head and the connecting end positioned in the longitudinal first bore; and a nut received in the enlarged diameter third bore proximate to a counter-bore end face defining a terminal end of the enlarged diameter third bore, the nut threadably connected to the threaded portion of the shank to retain the fastener within the body.

11. The electrical contact device of claim 10, wherein the body includes an access cavity oriented transverse to a longitudinal axis of the body, the access cavity providing access for outward routing of an electrical connector.

12. The electrical contact device of claim 10, further comprising a connector fitting connected to the electrical connector and positioned directly between the nut and counter-bore end face.

13. The electrical contact device of claim 10, wherein the connecting end of the biasing element when engaged with the male threaded head has a diameter larger than a diameter of the through second bore preventing the male threaded head and biasing element from extending into the through second bore.

14. The electrical contact device of claim 10, wherein the shank includes a shank diameter smaller than a diameter of the through second bore.

15. The electrical contact device of claim 10, wherein the shank includes an unthreaded portion positioned between the threaded portion and the male threaded head, the unthreaded portion positioned entirely within the through second bore.

16. The electrical contact device of claim 10, wherein the body is tubular and includes at least one outward facing circumferential slot receiving a compressible seal member.

17. The electrical contact device of claim 10, wherein the biasing element comprises a coiled spring having a plurality of compressed coils defining the connecting end.

18. An electrical circuit operating system, comprising:

an electrical contact device including:

a body of an electrically insulating material, the body including a longitudinal first bore having a first diameter, the first bore opening into a through second bore having a second diameter smaller than the first diameter, the through second bore subsequently opening into an enlarged diameter third bore having a third diameter greater than the first and second diameters;

a fastener received in the body, the fastener including a shank having a male threaded portion and a male threaded head; and a conductive biasing element having a connecting end engaged onto and over the male threaded head of the fastener, the connecting end and the male threaded head slidably received in the longitudinal first bore, and the shank slidably received in the through second bore; and a displaceable member forming a portion of an electrical circuit, the electrical circuit closed when the conductive biasing element is contacted by the displaceable member.

19. The system of claim 18, wherein the displaceable member comprises a piston.

20. The system of claim 19, further comprising a cylinder defining a piston chamber, wherein the piston is slidably disposed in the piston chamber to contact the biasing element closing the electrical circuit.

21. The system of claim 20, further including:

a resilient seal disposed about a perimeter of the body; and an end wall of the cylinder having a receiving bore slidingly receiving the body such that the seal creates a pressure boundary between the body and the end wall.

22. The system of claim 21, further comprising a mechanical connector received in the receiving bore to releasably retain the tubular body in the receiving bore.

23. The system of claim 20, further comprising a piston rod connected to the piston and displaceable with the piston, the piston rod displacing a member to break a crust of an aluminum processing bath.

24. The system of claim 18, wherein the conductive biasing element includes an extending portion axially extending from the connecting end.

25. The system of claim 24, wherein the conductive biasing element is a coiled compression spring having a plurality of abutting coil members defining the connecting end and a plurality of spaced coil members defining the extending portion.

26. The system of claim 18, further comprising:

a male threaded portion of the shank extending partially into the enlarged diameter third bore; and a nut positioned in the enlarged diameter third bore threadably engaged with the male threaded portion of the fastener to releasably couple the fastener to the tubular body.

27. An electrical circuit operating system, comprising:

a cylinder defining a cavity;

a cylinder end wall positioned at least partially in the cavity, the cylinder end wall having an elongated bore with a counterbore end wall;

an electrical contact device including:

a fastener including a shank having a male threaded portion and a male threaded head; and a conductive biasing element having a free end and a connecting end engaged onto and over the male threaded head of the fastener, the connecting end and the male threaded head slidably received in the elongated bore with the male threaded head contacting the counterbore end wall and the free end extending freely into the cavity; and a displacement member slidably disposed in the cavity and displaced to at least contact the free end of the conductive biasing element.

28. The electrical circuit operating system of claim 27, further including a nut threadably connected to the male threaded portion of the fastener to retain the fastener in the elongated bore.

29. The electrical circuit operating system of claim 28, further including a connector fitting in direct contact with the nut and positioned between the nut and the cylinder end wall, wherein the electrical circuit includes the piston, the biasing element, the fastener, and the connector fitting.

30. The electrical circuit operating system of claim 29, further including:

an electrical connector electrically connected to the fastener, and directly contacting the nut; and an aperture of the connector fitting sized to slidably receive the male threaded portion.

31. The electrical circuit operating system of claim 27, wherein the displacement member defines an electrically conductive piston having a face contacted by the free end of the conductive biasing element.

32. The electrical circuit operating system of claim 31, further including:

a piston rod connected to the piston and slidably received in the cylinder end wall; and a retaining member in contact with the cylinder and connected to the cylinder end wall.

33. The electrical circuit operating system of claim 32, wherein both the cylinder end wall and retaining member are in contact with and retained by a cover member.

34. The electrical circuit operating system of claim 27, wherein the cylinder end wall is a non-conductive material.

35. The electrical circuit operating system of claim 27, wherein the cylinder end wall is a self-lubricating polytetraflouroethylene material slidably receiving a piston rod connected to the displacement member.

36. The electrical circuit operating system of claim 27, wherein the displacement member forms a portion of an electrical circuit, the electrical circuit closed when the displacement member contacts the free end of the conductive biasing element.

37. The electrical circuit operating system of claim 27, wherein the cylinder, cylinder end wall, electrical contact device and the displacement member define a piston assembly of an alumina bath raw material feed tool.

* * * * *